US009611733B2

(12) United States Patent
Santoso et al.

(10) Patent No.: US 9,611,733 B2
(45) Date of Patent: Apr. 4, 2017

(54) COMMUNICATION SIGNAL REPEATER SYSTEM FOR A BOTTOM HOLE ASSEMBLY

(71) Applicant: Schlumberger Technology Corporation, Sugar Land, TX (US)

(72) Inventors: David Santoso, Sugar Land, TX (US); Shohachi Miyamae, Sagamihara (JP)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 14/838,473

(22) Filed: Aug. 28, 2015

(65) Prior Publication Data

US 2017/0058665 A1 Mar. 2, 2017

(51) Int. Cl.
*G01V 3/00* (2006.01)
*E21B 47/12* (2012.01)

(52) U.S. Cl.
CPC ..... *E21B 47/12* (2013.01)

(58) Field of Classification Search
CPC ..... E21B 47/12
USPC ..... 340/854.9
See application file for complete search history.

(56) References Cited

U.S. PATENT DOCUMENTS 4,887,309 A 12/1989 Andersson et al.
2003/0102995 A1 6/2003 Stolarczyk et al.
2005/0035874 A1 2/2005 Hall et al.
2007/0230542 A1* 10/2007 Okada ..... H04B 3/36 375/146
2008/0091932 A1* 4/2008 McNutt ..... G05B 19/054 713/1
2008/0253228 A1* 10/2008 Camwell ..... E21B 47/12 367/82
2009/0146836 A1* 6/2009 Santoso ..... G01V 11/002 340/854.4
2012/0176138 A1* 7/2012 Prammer ..... E21B 17/003 324/338
2013/0106615 A1* 5/2013 Prammer ..... G01V 3/30 340/854.6
2014/0177516 A1* 6/2014 Sonobe ..... H04B 3/36 370/315
2014/0311804 A1 10/2014 Gadot et al.
2015/0167449 A1 6/2015 Rodney
2015/0337652 A1* 11/2015 Rodney ..... E21B 47/16 367/82
2016/0047233 A1* 2/2016 Butner ..... H04W 4/00 340/853.7

(Continued)

OTHER PUBLICATIONS

International Search Report and Written Opinion issued in corresponding International application PCT/US2016/048272 on Nov. 24, 2016. 12 pages.

*Primary Examiner* — Hai Phan
*Assistant Examiner* — Zhen Y Wu

(57) ABSTRACT

A bottom hole assembly includes a cable to transmit power and communication signals. A first measurement-while-drilling tool is coupled with the cable. A second measurement-while-drilling tool is coupled with the cable. An adapter is coupled with the cable and positioned between the first and second measurement-while-drilling tools. The adapter includes a disconnect in the cable that prevents the power from being transmitted through the adapter. A repeater is coupled with the cable and amplifies the communication signals transmitted through the cable.

2 Claims, 5 Drawing Sheets

(56) References Cited

U.S. PATENT DOCUMENTS

| | | | | |
|---|---|---|---|---|
| 2016/0047236 | A1* | 2/2016 | Croux | H04B 11/00<br>367/82 |
| 2016/0109612 | A1* | 4/2016 | Hurlimann | G01V 3/32<br>324/303 |

* cited by examiner

COMMUNICATION SIGNAL REPEATER SYSTEM FOR A BOTTOM HOLE ASSEMBLY

FIELD

Embodiments described herein generally relate to bottom hole assemblies. More particularly, such embodiments relate systems and methods for transmitting data signals in a wellbore.

BACKGROUND INFORMATION

A bottom hole assembly may be run into a wellbore. The bottom hole assembly may include a measurement-while-drilling ("MWD") tool and a logging-while-drilling ("LWD") tool. The MWD tool may evaluate physical properties in the wellbore such as pressure, temperature, and wellbore trajectory. The LWD tool may measure formation properties such as resistivity, porosity, sonic velocity, and gamma rays. The MWD tool may provide power to the LWD tool. In addition, the MWD tool may store measurements obtained by the MWD tool and the LWD tool. The measurements may then be encoded and transmitted from the MWD tool to the surface (e.g., through one or more wires or via pressure pulses).

In recent years, as drilling has progressed to greater depths, the length of the bottom hole assembly has increased to accommodate more advanced (and longer) MWD and LWD tools. This has resulted in the distance between the MWD tool and the LWD tool, or between two or more LWD tools, increasing, which causes the signals transmitted therebetween to become attenuated.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

A bottom hole assembly is disclosed. The bottom hole assembly includes a cable to transmit power and communication signals. First and second measurement-while-drilling tools are coupled with the cable. An adapter is coupled with the cable and positioned between the first and second measurement-while-drilling tools. The adapter includes a disconnect in the cable that prevents the power from being transmitted through the adapter. A repeater is coupled with the cable and amplifies the communication signals transmitted through the cable.

In another embodiment, the bottom hole assembly includes a cable to transmit power and communication signals. First and second measurement-while-drilling tools are coupled with the cable. First, second, and third logging-while-drilling tools are coupled with the cable. The first logging-while-drilling tool is positioned between the first measurement-while-drilling tool and the second measurement-while-drilling tool. The second measurement-while-drilling tool is positioned between the first logging-while-drilling tool and the second logging-while-drilling tool. The second logging-while-drilling tool is positioned between the second measurement-while-drilling tool and the third logging-while-drilling tool. An adapter is coupled with the cable and positioned between the first logging-while-drilling tool and the second measurement-while-drilling tool. The adapter includes a disconnect in the cable that prevents the power from being transmitted therethrough. A repeater is coupled with the cable and amplifies the communication signals transmitted through the communication line.

A method for amplifying a signal in a wellbore is also disclosed. The method includes measuring a first parameter using a logging-while-drilling tool. A first communication signal including the first parameter from the logging-while-drilling tool is transmitted to a first measurement-while-drilling tool. The logging-while-drilling tool receives power from the first measurement-while-drilling tool. The first communication signal is amplified using a repeater positioned between the logging-while-drilling tool and the first measurement-while-drilling tool. Power is prevented from being transmitted between the first measurement-while-drilling tool and a second measurement-while-drilling tool using an adapter that is positioned between the first measurement-while-drilling tool and the second measurement-while-drilling tool.

BRIEF DESCRIPTION OF THE DRAWINGS

So that the recited features may be understood in detail, a more particular description, briefly summarized above, may be had by reference to one or more embodiments, some of which are illustrated in the appended drawings. It is to be noted, however, that the appended drawings are illustrative embodiments, and are, therefore, not to be considered to limit the scope of the application.

DETAILED DESCRIPTION

Figure 1:
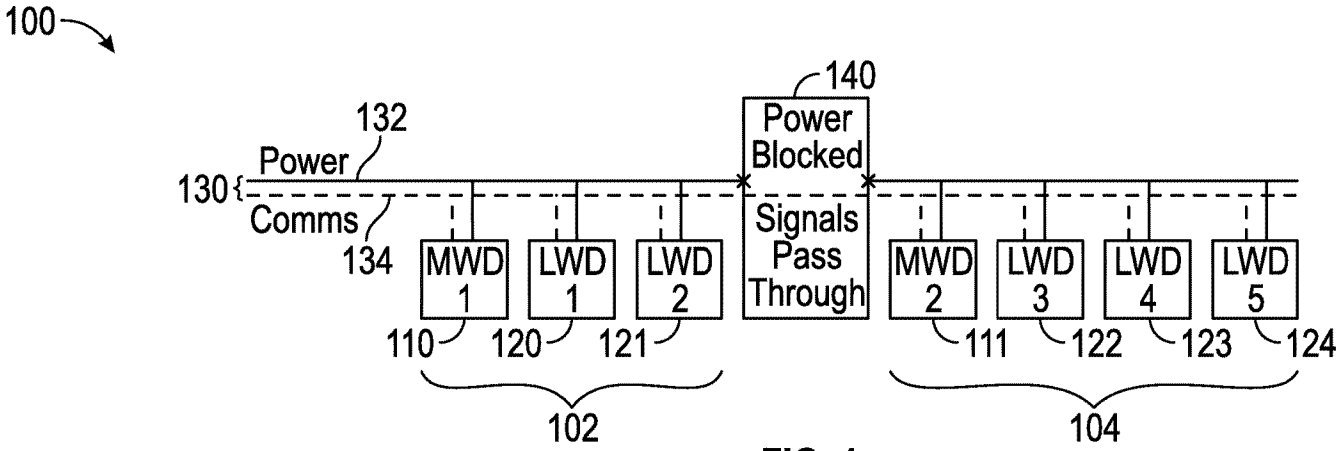
FIG. 1 depicts a schematic view of an illustrative bottom hole assembly ("BHA"), according to an embodiment.

FIG. 1 depicts a schematic view of an illustrative bottom hole assembly 100, according to an embodiment. The bottom hole assembly 100 may include one or more MWD tools (two are shown: 110, 111) and one or more LWD tools (five are shown: 120-124). As discussed above, the MWD tools 110, 111 may evaluate physical properties in the wellbore such as pressure, temperature, and wellbore trajectory, and the LWD tools 120-124 may measure formation properties such as resistivity, porosity, sonic velocity, and gamma ray.

The MWD tools 110, 111 and the LWD tools 120-124 may be coupled to a low power tool bus ("LTB") bus 130. As shown, the LTB bus 130 may include a power cable 132 and a communication cable 134. Although shown as two separate cables 132, 134 for illustrative purposes, in some embodiments, the bus 130 may include a single cable (or wire or conductor) that carries that carries both power (DC) and communication (AC). The MWD tools 110, 111 may generate and transmit power (e.g., DC power) to the LWD tools 120-124 through the power cable 132 in the LTB bus 130. In the example shown in FIG. 1, the MWD tool 110 may transmit power to the LWD tools 120, 121, and the MWD tool 111 may transmit power to the LWD tools 122-124.

The LWD tools 120-124 may transmit data/communication signals (e.g., AC signals) to the MWD tools 110, 111 through the communication cable 134. The communication signals may include measurements taken by the LWD tools 120-124. In another embodiment, the MWD tools 110, 111 may transmit communication signals to the LWD tools 120-124 through the communication cable 134. The communication signals may include instructions for which measurements to take, how often to take the measurements, etc.

The bottom hole assembly 100 may also include a dual MWD isolation adapter ("DMIA") 140. The DMIA 140 may facilitate the use of multiple MWD tools 110, 111 that each power one or more LWD tools 120-124. As shown, the DMIA 140 may include a disconnect in the power cable 132 that prevents power from being transmitted therethrough. Thus, each MWD tool 110, 111 and its respective LWD tools 120-124 may be considered to be a standalone sub-BHA 102, 104 in the bottom hole assembly 100. The DMIA 140 may, however, allow communication signals to pass therethrough via the communication cable 134.

Figure 2:
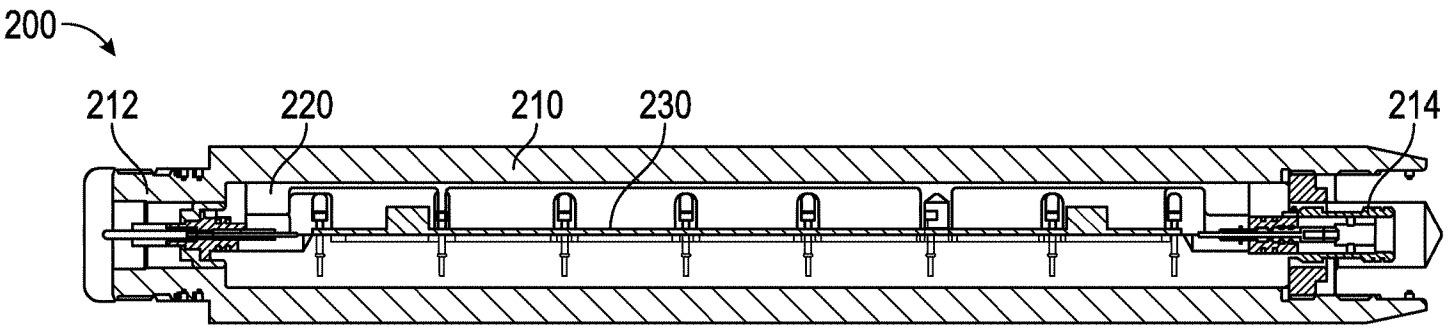
FIG. 2 depicts a cross-sectional view of an illustrative repeater, according to an embodiment.

FIG. 2 depicts a cross-sectional view of an illustrative repeater 200 that may be inserted into the bottom hole assembly 100, according to an embodiment. The repeater 200 may include a body 210. The body 210 may include a first connector 212 proximate to a first end thereof and a second connector 214 proximate to a second, opposing end thereof. In one example, the first connector 212 may be a male connector, and the second connector 214 may be a female connector, or vice versa.

A chassis 220 may be positioned within the body 210. One or more circuits 230 may also be positioned within the body 210 (e.g., mounted to the chassis 220). The circuits 230 in the repeater 200 may receive the communication signals transmitted from the MWD tools 110, 111 and/or the LWD tools 120-124 through the communication cable 134, amplify the communication signals to a higher level or power, and re-transmit the amplified communication signals. As used herein, "amplify" refers to increasing, boosting, and/or regenerating the communication in the signals. This may allow the communication signals to be transmitted over longer distances. In at least one embodiment, the signals may be amplified within a predetermined frequency range but not amplified outside of that frequency range. The circuits 230 may have a form factor similar to that of the DMIA 140 or be integrated with the DMIA 140. Illustrative circuits 230 (or portions thereof) are shown in FIGS. 5-9 and described below.

Figure 3:
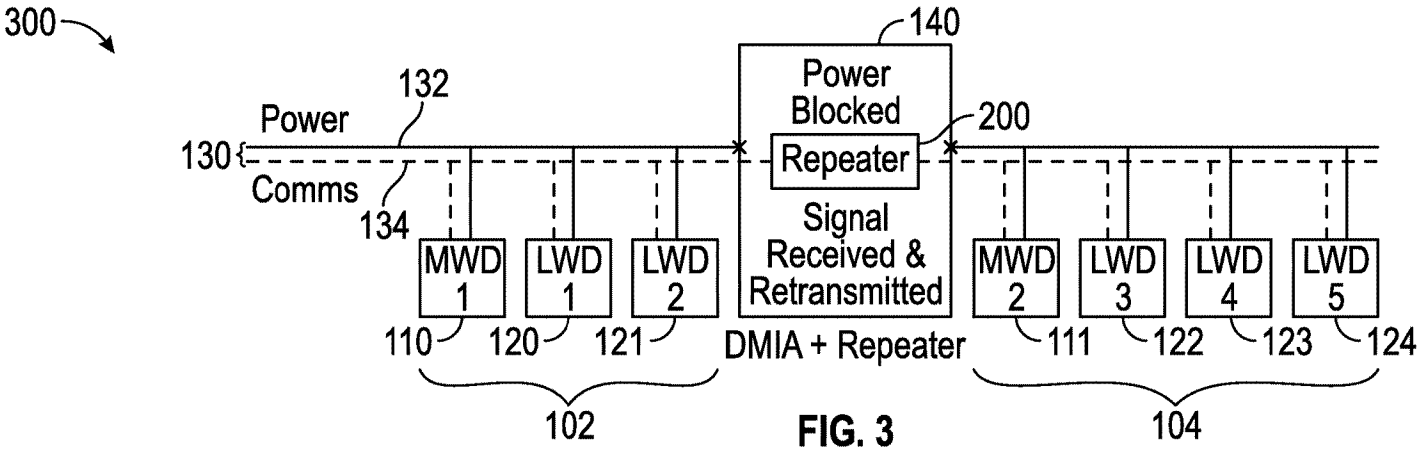
FIG. 3 depicts a schematic view of the bottom hole assembly including the repeater, according to an embodiment.

FIG. 3 depicts a schematic view of the bottom hole assembly 100 including the repeater 200, according to an embodiment. The repeater 200 may be positioned at various locations within the bottom hole assembly 100. As shown in FIG. 3, the repeater 200 may be coupled to and/or positioned within the DMIA 140. In another embodiment, the repeater 200 may be positioned within one of the MWD tools 110, 111 or the LWD tools 120-124.

Figure 4:
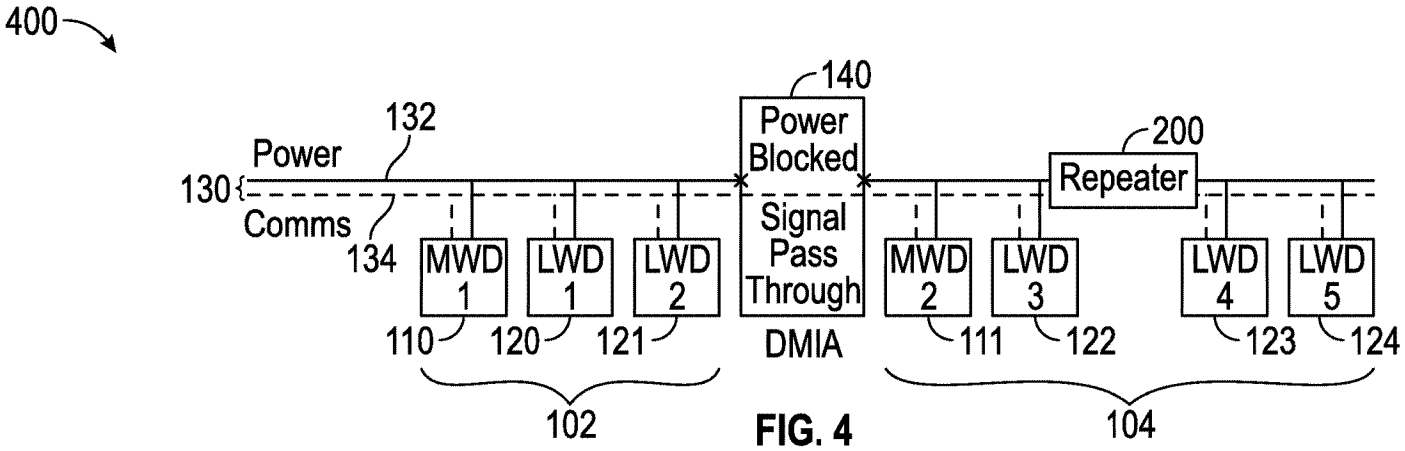
FIG. 4 depicts a schematic view of the bottom hole assembly with the repeater located in a different position, according to an embodiment.

In other embodiments, however, the repeater 200 may be positioned elsewhere in the bottom hole assembly 100. For example, as shown in FIG. 4, the repeater 200 may be in a sub that is positioned between a different pair of adjacent tools (e.g., LWD tools 122, 123) rather than positioned in the DMIA 140. More particularly, the first connector 212 of the repeater 200 may be coupled to the portion of the communication cable 134 that transmits communication signals to and from the LWD tool 122, and the second connector 214 of the repeater 200 may be coupled to the portion of the communication cable 134 that transmits data to and from the LWD tool 123.

In yet another embodiment, the repeater 200 may be coupled to and/or positioned within an extender between two adjacent tools (e.g., LWD tools 122, 123). As used herein, an "extender" refers to a connector that enables real-time communication and power transfer between logging and measurement tools. Both functions may be performed by a single wire with a return path through the tool's collar. Extenders may be located uphole or downhole and provide a link between LWD tools and MWD tools in a drill string.

Figure 5:
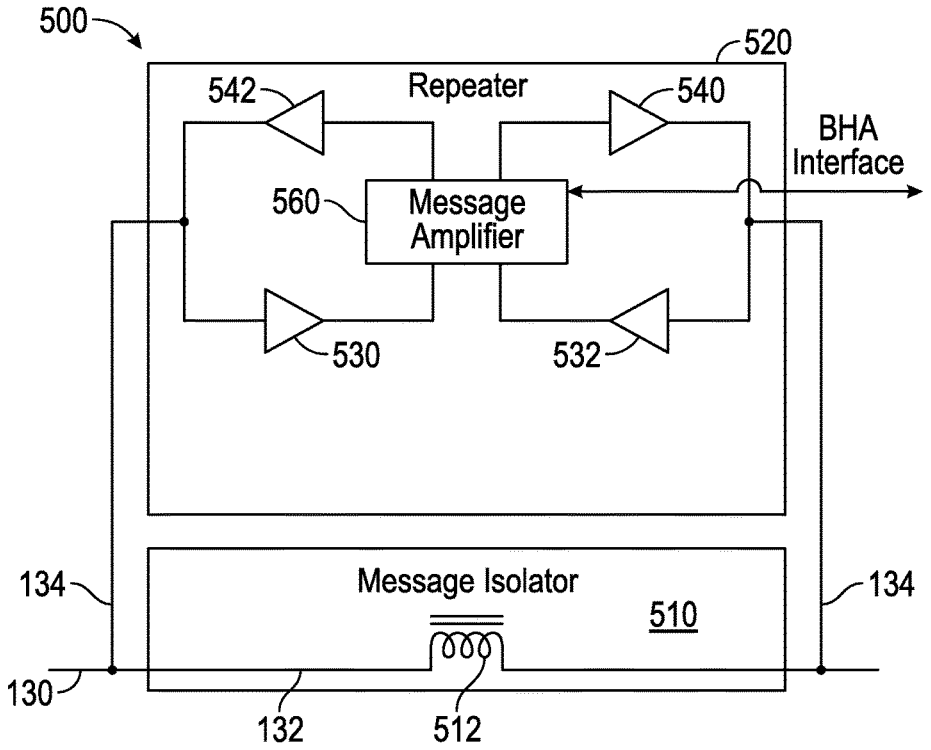
FIG. 5 depicts a schematic view of a full duplex repeater circuit that represents at least a portion of the circuit shown in FIG. 2, according to an embodiment.

FIG. 5 depicts a schematic view of a full duplex repeater circuit 500 that represents at least a portion of the circuit 230 shown in FIG. 2, according to an embodiment. The full duplex repeater circuit 500 may be a point-to-point system that is coupled (and in communication with) two or more tools. For example, the full duplex repeater circuit 500 may be coupled to and positioned between the LWD tools 122, 123, as shown in FIG. 4, and in communication with the MWD tools 110, 111 and the LWD tools 120-124.

The full duplex repeater circuit 500 may be configured to transmit communication signals in both directions one after another or simultaneously. For example, the full duplex repeater circuit 500 may be configured to transmit communication signals from the MWD tool 111 to the LWD tool 123 and from the LWD tool 124 to the MWD tool 111 simultaneously.

The full duplex repeater circuit 500 may include a message isolator module 510 and a repeater module 520. The power cable 132 may run through the message isolator module 510. As shown, in some embodiments, the message isolator module 510 may include an inductor 512, and the DC power in the power cable 132 may run through the inductor 512. The inductor 512 may have an impedance in the communication frequency band that is higher than the input impedance of the repeater 520. In this way, the communication signal (AC) may be blocked, but the power signal (DC) may pass through. The repeater module 520 may include one or more receivers (two are shown: 530, 532), one or more transmitters (two are shown: 540, 542), and a message amplifier 560.

A first communication signal may be received by the first receiver 530. The first communication signal may be amplified by the message amplifier 560 and then transmitted (e.g., to the LWD tool 123) by the first transmitter 540. Before, after, or simultaneously with the first communication signal passing through the repeater module 520, a second communication signal may pass through the repeater module 520. The second communication signal may be at a different frequency than the first communication signal (i.e., frequency division multiplexing). In another embodiment, the second communication signal may occur at a different time slot than the first communication signal (i.e., time division multiplexing). The second communication signal may be received by the second receiver 532. The second communication signal may be amplified by the message amplifier 560 and then transmitted (e.g., to the MWD tool 111) by the second transmitter 542. In at least one embodiment, in addition to amplifying/boosting the communication signal (s), the full duplex repeater circuit 500 may also analyze the communication signals (e.g., check for errors) and/or modify the communication signals (e.g., insert data such as signal to noise ratio, data error counts, etc.).

Figure 6:
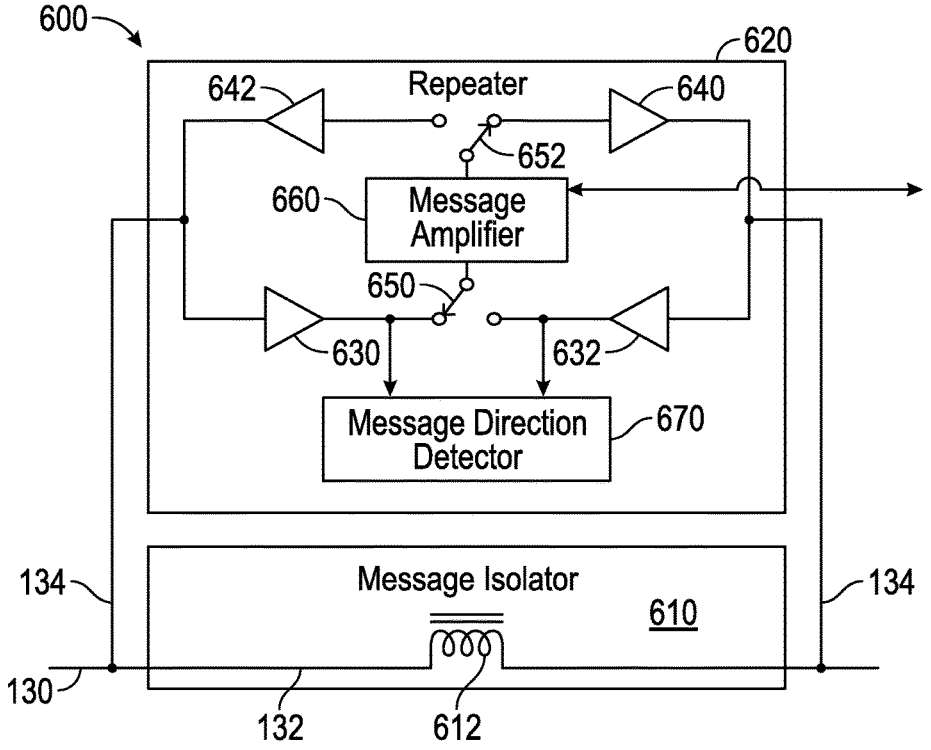
FIG. 6 depicts a schematic view of a half duplex repeater circuit that represents at least a portion of the circuit shown in FIG. 2, according to an embodiment.

FIG. 6 depicts a schematic view of a half duplex repeater circuit 600 that represents at least a portion of the circuit 230 shown in FIG. 2, according to an embodiment. The half duplex repeater circuit 600 may be a point-to-point system that is coupled (and in communication with) two or more tools. For example, the half duplex repeater circuit 600 may be coupled to and positioned between the LWD tools 122, 123, as shown in FIG. 4, and in communication with the MWD tools 110, 111 and the LWD tools 120-124. The half duplex repeater circuit 600 may be configured to transmit communication signals in both directions, but only one direction at a time (i.e., not simultaneously).

The half duplex repeater circuit 600 may include a message isolator module 610 and a repeater module 620. The power cable 132 may run through the message isolator module 610. As shown, in some embodiments, the message isolator module 610 may include an inductor 612, and the DC power in the power cable 132 may run through the inductor 612.

The repeater module 620 may include one or more receivers (two are shown: 630, 632), one or more transmitters (two are shown: 640, 642), one or more switches (two are shown: 650, 652), a message amplifier 660, and a message direction detector 670. The switches 650, 652, the message amplifier 660, and/or the message direction detector 670 may function as a field programmable gate array ("FPGA") that may have a digital modem implementation.

A first communication signal may be received by the first receiver 630. When the message direction detector 670 determines that the first communication signal is travelling in a first direction (e.g., left to right), the message direction detector 670 may cause the first switch 650 to provide a path of communication from the first receiver 630 to the message amplifier 660 and cause the second switch 652 to provide a path of communication from the message amplifier 660 to the first transmitter 640. The first communication signal may be amplified by the message amplifier 660 and then transmitted (e.g., to the LWD tool 123) by the first transmitter 640.

Before or after the first communication signal passes through the repeater module 620, a second communication signal may pass through the repeater module 620. More particularly, the second communication signal may be received by the second receiver 632. When the message direction detector 670 determines that the second communication signal is travelling in a second, opposing direction (e.g., right to left), the message direction detector 670 may cause the first switch 650 to provide a path of communication from the second receiver 632 to the message amplifier 660 and cause the second switch 652 to provide a path of communication from the message amplifier 660 to the second transmitter 642. The second communication signal may be amplified by the message amplifier 660 and then transmitted (e.g., to the MWD tool 111) by the second transmitter 642. As discussed above, in some embodiments, the communication signals may also be analyzed and/or modified before being re-transmitted.

Figure 7:
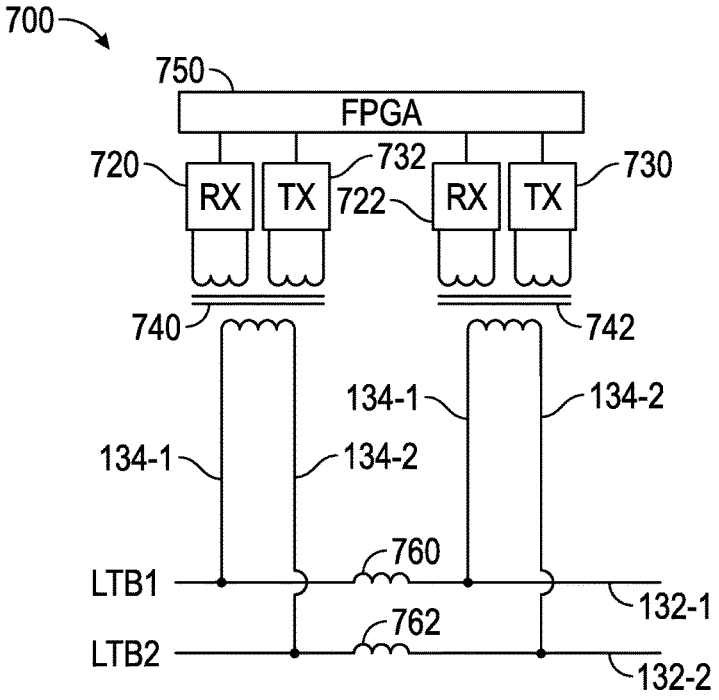
FIG. 7 depicts a schematic view of a half or full duplex repeater circuit (with one FPGA implementation) that represents at least a portion of the circuit shown in FIG. 2, according to an embodiment.

FIG. 7 depicts a schematic view of a half or full duplex repeater circuit 700 that represents at least a portion of the circuit 230 shown in FIG. 2, according to an embodiment. The repeater circuit 700 may include one or more receivers (two are shown: 720, 722), one or more transmitters (two are shown: 730, 732), one or more transformers (two are shown: 740, 742), and an FPGA 750.

A first portion of the communication cable 134-1 may transmit a first communication signal in a first direction (e.g., left to right). For example, the first communication signal may be travelling from the MWD tool 111 to the LWD tool 123 (see FIG. 4). The first communication signal may pass through the first transformer 740 and be received by the first receiver 720. The first communication signal may then be demodulated and then re-modulated by the FPGA 750 and sent to the first transmitter 730. The first transmitter 730 may transmit the first communication signal through the second transformer 742 and to the LWD tool 123. A first portion of the power cable 132-1 may transmit the power (e.g., from the MWD tool 111 to the LWD tool 123 (see FIG. 4), with the return power in power cable 132-2. The power cable(s) 132-1, 132-2 may include a first inductor 760 and a second inductor 762.

A second portion of the communication cable 134-2 may transmit a second communication signal in a second direction (e.g., right to left). For example, the second communication signal may be travelling from the LWD tool 124 to the MWD tool 111 (see FIG. 4). The second communication signal may pass though the second transformer 742 and be received by the second receiver 722. The second communication signal may then be demodulated and then re-demodulated by the FPGA 750 and sent to the second transmitter 732. The second transmitter 732 may transmit the second communication signal through the first transformer 740 and to the MWD tool 111.

Figure 8:
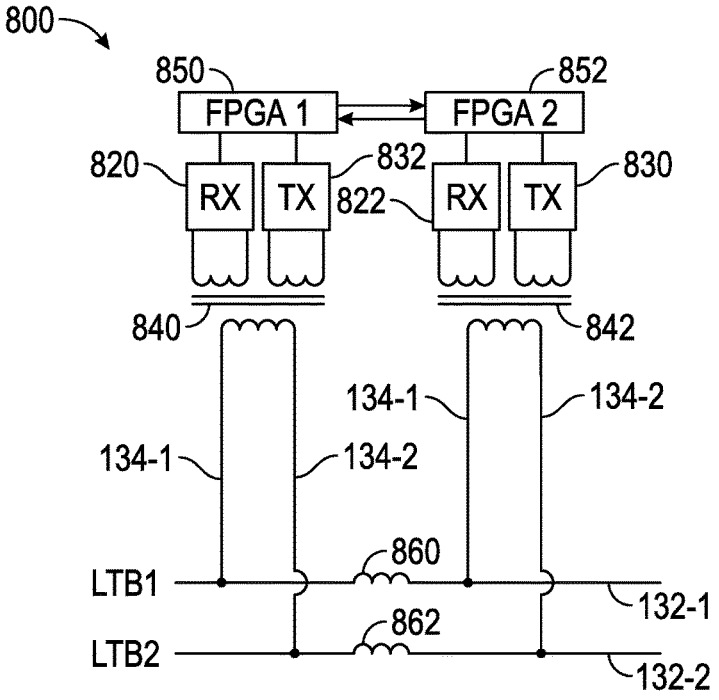
FIG. 8 depicts a schematic view of a half or full duplex repeater circuit (with two FPGA implementations) that represents at least a portion of the circuit shown in FIG. 2, according to an embodiment.

FIG. 8 depicts a schematic view of a half or full duplex repeater circuit that represents at least a portion of the circuit shown in FIG. 2, according to an embodiment. The repeater circuit 800 may include one or more receivers (two are shown: 820, 822), one or more transmitters (two are shown: 830, 832), one or more transformers (two are shown: 840, 842), and one or more FPGAs (two are shown: 850, 852).

A first portion of the communication cable 134-1 may transmit a first communication signal in a first direction (e.g., left to right). For example, the first communication signal may be travelling from the MWD tool 111 to the LWD tool 123 (see FIG. 4). The first communication signal may pass through the first transformer 840 and be received by the first receiver 820. The first communication signal may then be demodulated by the first FPGA 850 and then re-modulated by the second FPGA 852 and sent to the first transmitter 830. The first transmitter 830 may transmit the first communication signal through the second transformer 842 and to the LWD tool 123. A first portion of the power cable 132-1 may transmit the power (e.g., from the MWD tool 111 to the LWD tool 123 (see FIG. 4), with the return power in power cable 132-2. The power cable(s) 132-1, 132-2 may include a first inductor 860 and a second inductor 862.

A second portion of the communication cable 134-2 may transmit a second communication signal in a second direction (e.g., right to left). For example, the second communication signal may be travelling from the LWD tool 124 to the MWD tool 111 (see FIG. 4). The second communication signal may pass though the second transformer 842 and be received by the second receiver 822. The second communication signal may then be demodulated by the second FPGA 852 and then re-modulated by the first FPGA 850 and sent to the second transmitter 832. The second transmitter 832 may transmit the second communication signal through the first transformer 840 and to the MWD tool 111.

Figure 9:
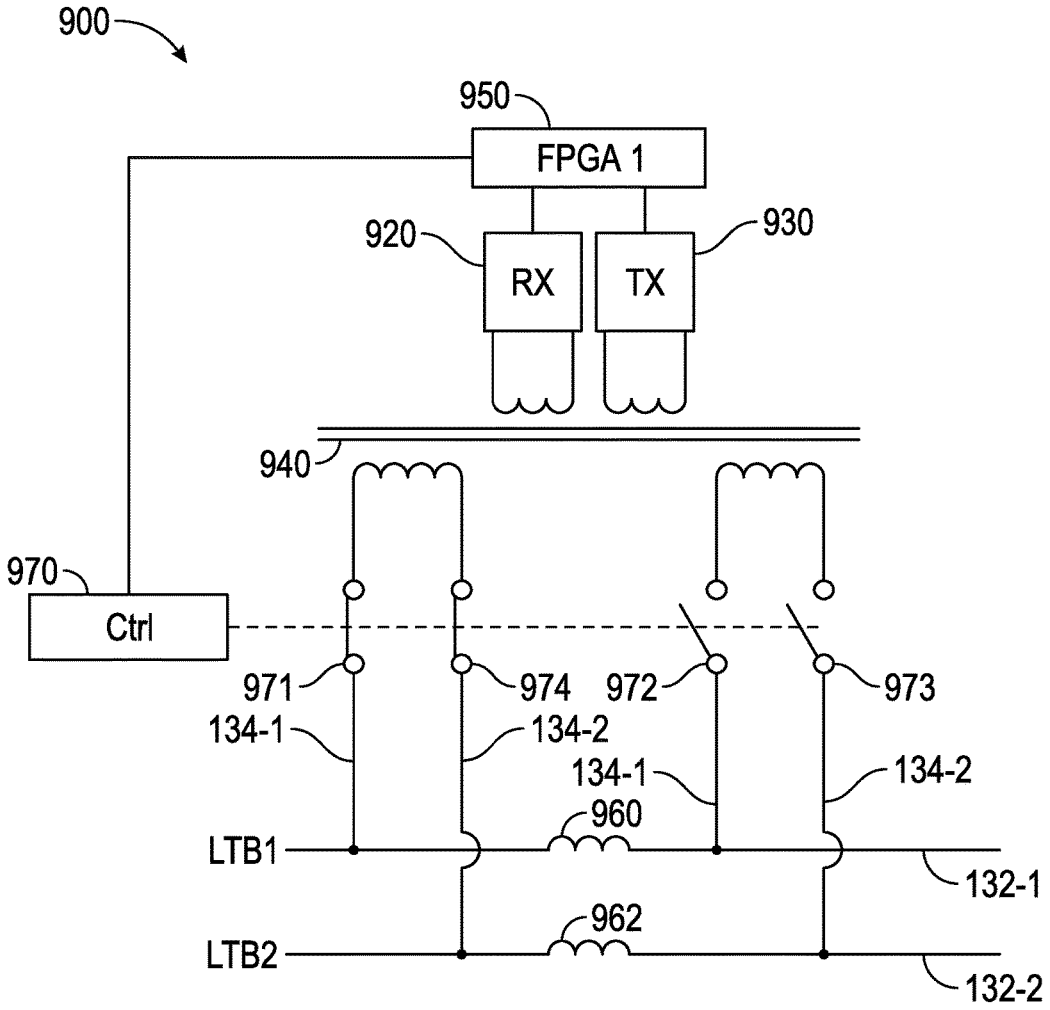
FIG. 9 depicts a schematic view of a half duplex repeater circuit (with a one transformer implementation) that represents at least a portion of the circuit shown in FIG. 2, according to an embodiment.

FIG. 9 depicts a schematic view of a half duplex repeater circuit 900 that represents at least a portion of the circuit 230 shown in FIG. 2, according to an embodiment. The circuit 900 may include one or more receivers (one is shown: 920), one or more transmitters (one is shown: 930), one or more transformers (one is shown: 940), and one or more FPGAs (one is shown: 950).

A first portion of the communication cable 134-1 may transmit a first communication signal in a first direction (e.g., left to right). For example, the first communication signal may be travelling from the MWD tool 111 to the LWD tool 123 (see FIG. 4). The first communication signal may pass through switches 971, 974 and the transformer 940 and be received by the receiver 920. The first communication signal may then be demodulated and then re-demodulated by the FPGA 950. At this point, the FPGA 950 may send a command to a control circuit 970 to open the switches 971, 974 and close the switches 972, 973. The first communication signal may then be re-transmitted by the transmitter 930, through the transformer 940 and switches 972, 973, to, for example, the LWD tool 123. A first portion of the power cable 132-1 may transmit the power (e.g., from the MWD tool 111 to the LWD tool 123 (see FIG. 4), with the return power in power cable 132-2. The power cable(s) 132-1, 132-2 may include a first inductor 960 and a second inductor 962.

A second portion of the communication cable 134-2 may transmit a second communication signal in a second direction (e.g., right to left). For example, the second communication signal may be travelling from the LWD tool 124 to the MWD tool 111 (see FIG. 4). The second communication signal may be transmitted before or after the first communication signal. The second communication signal may pass through switches 972, 973 and the transformer 940 and be received by the receiver 920. The second communication signal may then be demodulated and then re-demodulated by the FPGA 950. At this point, the FPGA 950 may send a command to the control circuit 970 to open the switches 972, 973 and close the switches 971, 974. The second communication signal may then be re-transmitted by the transmitter 930, through the transformer 940 and switches 971, 974, to, for example, the MWD tool 111.

As used herein, the terms "inner" and "outer"; "up" and "down"; "upper" and "lower"; "upward" and "downward"; "above" and "below"; "inward" and "outward"; and other like terms as used herein refer to relative positions to one another and are not intended to denote a particular direction or spatial orientation. The terms "couple," "coupled," "connect," "connection," "connected," "in connection with," and "connecting" refer to "in direct connection with" or "in connection with via one or more intermediate elements or members."

Although the preceding description has been described herein with reference to particular means, materials, and embodiments, it is not intended to be limited to the particulars disclosed herein; rather, it extends to all functionally equivalent structures, methods, and uses, such as are contemplated within the scope of the appended claims. While the foregoing is directed to embodiments of the present invention, other and further embodiments of the invention may be devised without departing from the basic scope thereof.

What is claimed is:

1. A bottom hole assembly, comprising:

a cable configured to transmit power and communication signals;

a first measurement-while-drilling tool coupled with the cable;

a second measurement-while-drilling tool coupled with the cable;

an adapter coupled with the cable and positioned between the first and second measurement-while-drilling tools, wherein the adapter comprises a disconnect in the cable that prevents the power from being transmitted through the adapter; and a repeater coupled with the cable and configured to amplify the communication signals transmitted through the cable wherein the repeater comprises:

a first transformer coupled with a first portion of the cable, wherein the first transformer is configured to amplify the communication signals that are travelling in a first direction;

a second transformer coupled with the first portion of the cable, wherein the second transformer is configured to amplify the communication signals that are travelling in a second, opposing direction;

a first receiver coupled with the first transformer, wherein the first receiver is configured to receive the communication signals travelling in the first direction after the communication signals travelling in the first direction pass through the first transformer;

a second receiver coupled with the second transformer, wherein the second receiver is configured to receive the communication signals travelling in the second direction after the communication signals travelling in the second direction pass through the second transformer;

a field programmable gate array coupled to the first and second receivers and configured to modulate or demodulate the communication signals received by the first and second receivers;

a first transmitter coupled with the field programmable gate array and the first portion of the cable, wherein the first transmitter is configured to transmit the communication signals travelling in the first direction after the communication signals travelling in the first direction are demodulated and then re-modulated by the field programmable gate array; and a second transmitter coupled with the field programmable gate array and a second portion of the cable, wherein the second transmitter is configured to transmit the communication signals travelling in the second direction after the communication signals travelling in the second direction are demodulated and then re-demodulated by the field programmable gate array.

2. The bottom hole assembly of claim 1, wherein the field programmable gate array further comprises:

a first field programmable gate array configured to demodulate the communication signals travelling in the first direction; and a second field programmable gate array configured to re-modulate the communication signals travelling in the first direction.

* * * * *